United States Patent [19]

Verty et al.

[11] 4,381,124

[45] Apr. 26, 1983

[54] METHOD OF MINING AN OIL DEPOSIT

[76] Inventors: Vladimir G. Verty, poselok Yarega, ulitsa Kosmonavtov, 4, kv. 29; Pavel G. Voronin, poselok Yarega, ulitsa Mira, 4, kv. 6; Evgeny I. Gurov, poselok Yarega, ulitsa Mira, 2, kv. 3; Vitaly S. Zubkov, poselok Yarega, ulitsa Mira, 3, kv. 4; Alexandr I. Obrezkov, poselok Yarega, ulitsa Neftyanikov, 1, kv. 14, all of, Komi ASSR, Ukhta; Vladimir P. Tabakov, ulitsa Sofii Kovalevskoi, 4-A, kv. 125, Moscow; Boris B. Khvoschinsky, poselok Yarega, ulitsa Kosmonavtov, 5, kv. 17, Komi ASSR, Ukhta; Vladimir N. Judin, ulitsa Oplesnina, 30, kv. 35, Komi ASSR, Ukhta, all of U.S.S.R.

[21] Appl. No.: 223,896

[22] Filed: Jan. 9, 1981

[51] Int. Cl.[3] ..... E21C 41/10

[52] U.S. Cl. ..... 299/2; 166/50; 166/272

[58] Field of Search ..... 299/2; 166/50, 272

[56] References Cited

U.S. PATENT DOCUMENTS

| | | | |
|---|---|---|---|
| 1,520,737 | 12/1924 | Wright | 166/68 X |
| 4,020,901 | 5/1977 | Pisio et al. | 166/272 X |
| 4,099,783 | 7/1978 | Verty et al. | 299/2 |
| 4,201,420 | 5/1980 | Likholai et al. | 299/2 |
| 4,265,485 | 5/1981 | Boxerman et al. | 299/2 |
| 4,283,088 | 8/1981 | Tabakov et al. | 299/2 |

*Primary Examiner*—Ernest R. Purser

*Attorney, Agent, or Firm*—McAulay, Fields, Fisher, Goldstein & Nissen

[57] ABSTRACT

A method of mining an oil deposit, wherein a plurality of underground workings with inlet and recovery galleries are provided in an oil-bearing bed. From the inlet galleries inlet wells are drilled, and from the recovery galleries—recovery wells. A heat carrier is supplied through the recovery wells to the oil-bearing bed and oil is extracted from the recovery wells. In so doing, each inlet gallery is arranged in the bed between two recovery galleries and near the faces of the recovery wells, while the inlet and recovery wells in the oil-bearing bed portions between the inlet and recovery galleries are drilled towards each other such that they should alternate to envelop the oil-bearing bed in a uniform network of wells.

12 Claims, 4 Drawing Figures

METHOD OF MINING AN OIL DEPOSIT

BACKGROUND OF THE INVENTION

The present invention relates to improving extraction of oil from oil fields and, more particularly, to a method of thermal-mining production of oil which can be used in the petroleum industry.

This invention can be used most efficiently in the extraction of oil from highly viscous oils and fluid asphalts.

The invention can also be used for developing oil deposits with depleted reservoir energy.

At present, such deposits cannot be efficiently developed by the conventional method wherein oil production is accomplished with the aid of wells drilled from the ground surface. The resulting recovery is rather low.

DESCRIPTION OF THE PRIOR ART

Known in the art for developing oil fields with highly viscous oils and fluid asphalts is a mining method of oil production without lifting oil-bearing rock to the earth's surface (cf., A. Ya. Krems et al., Shahtnaiya razrabotka neftianyh mestorozhdenii—The Mining of Oil Deposits, Gostoptehizdat Publishers, Moscow, 1955).

This prior art method comprises driving, above the roof of the oil-bearing bed, a system of underground workings including fringe drifts with drill chambers. From the drill chambers, inclined and straight wells are drilled whose depth depends on the thickness of the oil-bearing bed and the distance from its roof to the drill chambers. After drilling the wells, oil is recovered therefrom by the flowing method and then by air-lift.

When employing the flowing method, oil is lifted from the oil-bearing bed through the wells to the drill chambers by reservoir pressure; in the case of air-lift, compressed air is injected via pipes placed in the well. From the drill chambers, oil is delivered via underground workings to central underground oil collectors from which it is pumped, following primary preparation and preheating, into tanks located on the ground surface.

This method helps increase the recovery by a factor of three and above as compared with the development by means of wells drilled from the earth's surface. However, the absolute value of recovery amounts to only about 6%.

Low recovery caused a need to employ mining methods of oil production, which provide for physically affecting an oilbearing bed and the oil contained in the latter.

There is known in the art a method of thermal-mining production of oil involving the exposure of the bed to the effect of steam and heat (cf., V. N. Mishakov et al., Opyt primeneniya teplovyh metodov pri shahtnoi razrabotke mestorozhdenii vysokoviazkih neftei—On the Use of Thermal Methods upon Mining Highly Viscous Oil Deposits, in Neftianoye hozyiaistvo—Journal of Petroleum Industry, No. 10, 1974, pp. 31–35).

The above-mentioned art method provides for driving above the oil-bearing bed a plurality of underground workings including shafts, shaft workings, drifts and drill chambers.

From the drill chambers located in the drifts, straight and inclined inlet and recovery wells are drilled. A heat carrier (steam) is supplied to the oil-bearing bed via inlet wells, which drives oil from the inlet wells to the recovery wells. From the face of the recovery wells, oil is air-lifted to the drill chambers.

Said prior art method suffers from the accumulation of sand in the recovery wells operating by the air-lift method and of the inlet wells. The recovery and inlet wells are clogged with sand from the bed.

In addition, the air-lift technique of oil production calls for equipping the wells with special pipes or devices for closing and opening the supply of air, when required, while considerable amounts of air are needed for the delivery of liquid from the wells.

This prior art method suffers from a low efficiency of the process of thermal-mining production of oil due to considerable heat losses through well walls into "barren", oil-free rock, as well as from the large amount of drilling to be done in such rock.

According to still another prior art method of oil mining (cf., U.S. Pat. No. 1,634,235), wells are drilled from underground workings located below the oil-bearing bed, and oil is extracted from shallow wells drilled from the bottom upwards. The underground workings are in this case arranged radially from the central shaft over the mining field area.

This prior art method provides for extraction of oil from the bed by gravity while the face zone of the bed is heated by way of supplying steam to the well face via pipes located in the wells.

This method suffers from non-uniform arrangement of underground workings and wells over the mine field area. Mine field portions adjoining the shaft are developed with the aid of a dense network of wells. Bed portions remote from the shaft are developed with the aid of a sparse network of wells. Such an arrangement of wells results in non-uniform mining of oil reserves.

There is also known a mining method of oil production (cf., U.S. Pat. No. 1,520,737), according to which a vertical shaft is driven through the oil-bearing bed below which a drill chamber is arranged from which inclined and ascending wells are drilled in a radial direction.

A heat carrier (steam) is supplied to the oil-bearing bed through said wells via pipes having a diameter smaller than that of the well. Heated oil flows down into the drill chamber after which it is pumped up to the ground surface.

Although this prior art method makes for a simpler process of oil recovery for an increased recovery, the bed portion under development is limited by the possibilities of drilling the inclined wells or, to be more precise, by their length. Therefore, a limited bed portion is to be provided with an individual shaft built from the earh's surface. This affects considerably the economics thereof.

Yet another mining method of developing an oil deposit, known in the art, involves the heating of oil-bearing bed by periodic injection of steam from underground workings located above a recovery gallery, via a system of inlet wells.

Without discontinuing the injection of steam, fluid such as oil and water is periodically extracted via recovery wells drilled from the recovery gallery located in the bottom portion of the oil-bearing bed. This is followed by periodic injection of hot and then cold water, while continuing the extraction of fluid via recovery wells.

This latter prior art method, regarded by the inventors as prototype of the method according to the present invention, is accomplished in the form of either a two-horizon system or a two-stage system.

Both systems suffer from a non-uniform coverage of the oil-bearing bed by the displacement process and, as a result, from low recovery.

In the case of the two-horizon system, large amounts of heat are lost to overlying rock through the walls of inlet wells, which affects the bed-heating efficiency.

In the case of the two-stage system, the bed-heating efficiency is reduced considerably because of non-uniformity of thermal effect upon the oil-bearing bed, as a result of which the peripheral zones of the area under development are heated slowly and oil fails to assume desired fluidity, this leading to lower recovery.

OBJECTS AND SUMMARY OF THE INVENTION

It is the primary object of the present invention to develop a method of mining an oil deposit for improving current oil production and the rate of oil extraction from the deposit.

It is another object of this invention to develop a method of mining an oil deposit which has increased heat efficiency.

It is still another object of the present invention to provide a method of mining an oil deposit which reduces the amount of drilling to be done in "barren", oil-free rock.

These and other related objects of the present invention are accomplished in the herein disclosed method of mining an oil deposit, which comprises:

arranging a plurality of underground workings and recovery galleries;

drilling recovery wells in rows from the recovery galleries;

arranging inlet galleries, each of them in the bed between two recovery galleries near the faces of the recovery wells;

drilling inlet wells from the inlet galleries towards the recovery wells such that the inlet and recovery wells should alternate in the oil-bearing bed portions between the inlet and recovery galleries to envelop the bed in a uniform network of wells;

force-feeding a heat carrier to the oil-bearing bed through the inlet wells for heating the bed to a temperature at which oil assumes desired fluidity in the latter and for displacing oil to the recovery wells;

extracting oil from the recovery wells to the recovery galleries; and delivering oil from the recovery galleries via underground workings to the ground surface.

The improvement of the method according to the present invention consists in that the inlet gallery is arranged near the faces of the recovery wells, while the inlet and recovery wells in the oil-bearing bed portion between the inlet and recovery galleries are drilled towards each other such that they envelop the bed in a uniform network of wells.

An increase of current oil production and of the rate of oil extraction from the oil-bearing bed is attained as a result of heating the oil-bearing bed and oil contained in the latter and , consequently, as a result of reducing the oil viscosity, expanding oil and increasing reservoir pressure. Owing to a better coverage of the bed by the process of oil displacement by the heat carrier and a more uniform heating of the bed, an increase in recovery is attained.

An increased efficiency of the bed heating process is attained as a result of reducing heat losses through the walls of inlet wells which are drilled in the oil-bearing bed, as well as owing to additional heating of the bed upon the influx of heated oil via shaft of the recovery well through less heated portions of the bed.

The efficiency of the oil production process is attained owing to an increased recovery and higher rates of developing oil deposits, as well as owing to a manifold, sometimes complete, reduction of the amount of well drilling in "barren", oil-free rock.

The herein disclosed method provides for the maximum possible degree of bed drainage by means of horizontal, flatdipping and flat-raise wells which extend over the oil-bearing bed through dozens and hundreds of meters to interconnect its inhomogeneous zones, various channels, cracks and caverns and to increase the degree of bed completion.

The method of the invention further provides for ensuring, along with the oil displacement mode, conditions required for a display of gravity flow of oil, as well as the maximum possible simplification of the conditions of well operation.

It is expedient that in oil-bearing beds whose top portion is made up of poorly cemented loose rock or markedly fissured rock, with high-pressure water-bearing beds located below such oil-bearing beds, the inlet and recovery galleries should be located in the bottom portion of the oil-bearing bed.

With the inlet and recovery galleries located in the bottom portion of the bed, the inlet and recovery wells are fully located in the oil-bearing bed. Naturally, this helps fully eliminate heat losses to "barren" rock through well walls due to heat conductivity. All of the heat is consumed for heating the oil-bearing bed.

It is further expedient that in oil-bearing beds made up of poorly cemented and loose rock, with beds of stable and hard rock located therebelow, the inlet and recovery galleries should be located below the oil-bearing bed.

The arrangement of the recovery galleries below the oil-bearing bed makes for improved operating conditions of raise wells thanks to a reduced possibility of sand plugging. Underground air in the inlet and recovery galleries is improved owing to the location of said galleries in oil-free rock.

Since the tops of the inlet and recovery wells are in a water-bearing bed, favorable conditions exist for their sealing. Shaft portions of wells drilled in water-bearing bed present, as a rule, an insignificant fraction of the well length. In this case, heat losses to "barren" rock are negligible owing, first, to a reliable insulation of the wells in the top portion and, second, to the tendency of heat to move upwards, i.e., to the zone of oil extraction from the deposit.

BRIEF DESCRIPTION OF THE DRAWINGS

The present invention will be better understood upon considering the following detailed description of an exemplary embodiment thereof, reference being had to the accompanying drawings in which.

DESCRIPTION OF THE PREFERRED EMBODIMENTS

The herein disclosed method is realized in the following manner.

Figure 2:
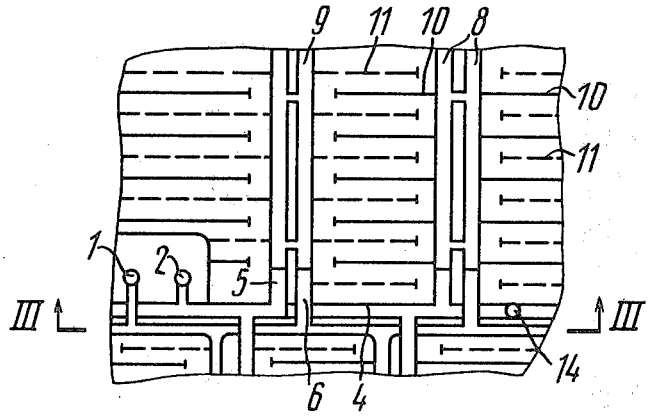
FIG. 2 is a plan view of a portion of oil-bearing bed under development with inlet and recovery wells and underground workings wherein underground workings and wells are conventionally superposed in a single horizontal plane.
Figure 3:
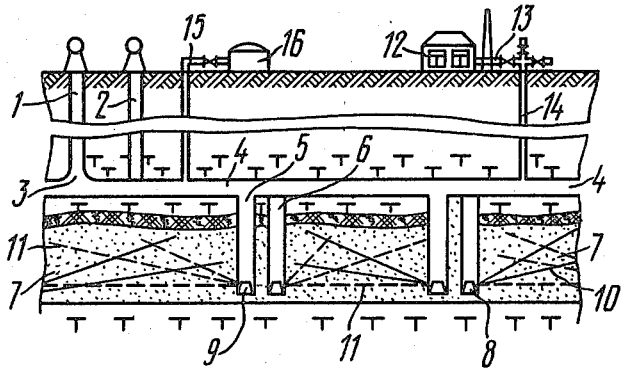
FIG. 3 is a section taken along the line III—III of FIG. 2 for the case when the inlet and recovery galleries are located in the bottom portion of the oil-bearing bed.

A plurality of underground workings is set up, including two shafts, namely, a winding shaft 1 (FIGS. 2, 3) and a ventilating shaft 2, a mine yard 3 (FIG. 3), shaft workings which house a locomotive barn, a pumping station, storages etc. (not shown in the drawings), drifts 4, inclined workings 5 and 6 (FIGS. 2 and 3). The drifts 4 are driven above the top of an oil-bearing bed 7 (FIG. 3) and inclined horizon at an angle of from 1 to 3° from the horizontal.

The inclined workings 5 and 6 are driven from the drifts 4 (FIGS. 2 and 3) to the bottom portion of the bed or below the latter, where at least one inlet gallery 8 and recovery gallery 9 are set up.

The inlet galleries 8 are located near the faces of recovery wells (11). Both the inlet and recovery galleries (8 and 9, respectively) may be rectilinear (as shown in FIG. 2) or curvilinear, depending on the shape of the area under development.

Upon delivery of steam via horizontal or flat-raise inlet wells 10, pressure losses over the well length cause a pressure drop between the well top and face. At the same time, there is observed a temperature drop over the length of the inlet wells 10, caused by the transfer of heat to the oil-bearing bed 7 saturated with liquids.

Figure 1:
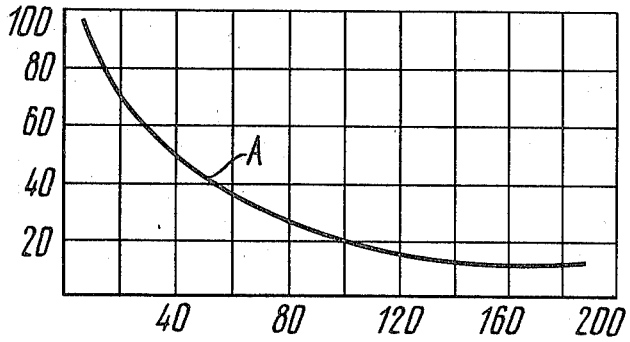
FIG. 1 shows the variation of the mean temperature of the oil-bearing bed over the length of a horizontal inlet well.

Since low delivery pressures are employed in oil wells, low-temperature steam arrives to the tops of the inlet wells 10, while it is practically a condensate (hot water) that arrives to the well faces. Curve A in FIG. 1 indicates the mean temperature of the bed over the length of a horizontal well in one of the actual portions of the oil well.

In the bed zone adjoining the top portion of the inlet well 10 (FIGS. 2 and 3), heating is carried out by to conductivity inasmuch as this part of the well is cased-with a string. In the zone of the oil-bearing bed 7 (FIG. 3) adjoining the face portion of the inlet well 10, the bed is heated by convection heat transfer. In the face portion of the well, the pressure and temperature are rather low and have no considerable effect upon the heating of the oil-bearing bed 7.

When delivering steam at low pressures, as is often the case, the heating of the oil-bearing bed 7 is mainly accomplished by to heat conductivity from the shafts of the horizontal inlet wells 10.

As seen from the chart (curve A) showing the well length dependence of the mean temperature (FIG. 1), the highest temperature is observed in the top portion of the well. This entails an increase of the temperature of the walls of the gallery 8 (FIGS. 2 and 3) from which the wells are drilled, as well as an increased release of heat to underground air. If both inlet and recovery wells are located in one and the same gallery, this leads to aggravation of the working conditions for the personnel engaged in the recovery of oil from the recovery wells.

An increase of the amount of air used for airing causes large heat losses from the bed which, in turn, affects adversely the heating efficiency and the heat balance of the process thermally influencing the oilbearing bed 7 (FIG. 3).

In order to eliminate the afore-described disadvantages, the inlet and recovery galleries (8 and 9, respectively) are located in the bottom portion of the oil-bearing bed 7 or below the latter, the inlet galleries 8 being located near the faces of the bottom row of the recovery wells 11.

Oil assuming desired fluidity in the portions adjoining the tops of the inlet wells 10 arrives to the faces of the recovery wells 11 and then, via shafts of the recovery wells 11, to the recovery gallery 9. The heat received by oil in this zone is partly transferred to the bed upon oil movement towards the recovery gallery 9. This makes for the heating of the oilbearing bed 7 over the entire volume thereof thanks to a better coverage of the bed by the heat carrier which, in turn, helps increase the efficiency of heating the oil-bearing bed 7 and recovery factor thereof.

At the same time, temperature conditions permissible from the standpoint of labor protection and safety regulations are maintained in the recovery gallery 9 where most of the workers are stationed.

The heating front having a preset temperature gradually moves towards the recovery gallery 9 (in the direction of oil extraction via recovery wells) since the heat carrier is delivered via inlet wells 10 whose tops are near the faces of the recovery wells 11. Therefore, the extraction of oil and movement of the heating front are effected in the same direction. The time of the heating front arrival to the recovery gallery 9 can be controlled by the delivery pressure and heat carrier temperature, which, in turn, along with the better coverage of the bed by the heat carrier, offers an important technological advantage such as the setting up of proper working conditions for the personnel in the recovery gallery 9 by reducing the ambient temperature gallery.

The inlet wells 10 and recovery wells 11 in the oil-bearing bed portion between the inlet gallery 8 and recovery gallery 9 are drilled towards each other such that they envelop the bed in a uniform network of wells.

The inlet wells 10 are drilled from the inlet gallery 8 uniformly over the area under development. In particular, the inlet wells 10 may be drilled parallel to each other, as shown in FIG. 2.

The recovery wells 11 are drilled from the recovery gallery 9 (FIGS. 2, 3) also uniformly over the area under development such that the tops of the inlet wells be located near the faces of the recovery wells. In the case of a rectilinear recovery gallery 9, the recovery wells 11 are drilled parallel to each other.

The heat carrier (for example, steam) is delivered to the tops of the inlet wells 10 from a boiler unit 12 located on the ground surface, via ground pipeline 13 through a steamsupply well 14 and underground pipelines (not shown) located in the drifts 4.

The heat carrier is injected into the oil-bearing bed 7 via system of inlet wells 10. Inasmuch as the tops of the inlet wells 10 are located near the faces of the recovery wells 11, the oil first assumes the desired fluidity in the portions of the oilbearing bed 7 adjoining the zone of the tops of the inlet wells 10.

Oil is fed via the shaft of the recovery well 11 to the recovery gallery 9 and then to ditches or pipelines provided in the drifts 4.

Together with water supplied to the ditches or pipelines, oil is conveyed by gravity owing to the inclination of the workings to the horizontal on the order of 1–3° towards oil trapping units (not shown in the drawings) where it is separated from the bulk of water. Pumps can be used for conveying oil with associated water to said units via pipelines. From the oil trapping units oil is pumped over to central underground oil collectors (not shown in the drawings) from which it is fed, following primary preparation and preheat, via pipelines and through special wells 15 or through the shaft into oil storage tanks 16 located on the ground surface.

Figure 4:
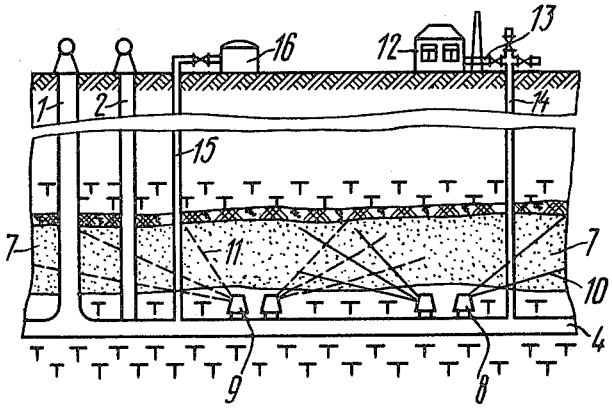
FIG. 4 is a section taken along the line III—III of FIG. 2 for the case when the inlet and recovery galleries are located below the oil-bearing bed.

The method will remain essentially the same if the drifts 4 (FIG. 4) are provided below the oil-bearing bed 7. Moreover, such an arrangement of the drifts offers better conditions for the delivery of oil thereinto from the recovery galleries 9.

In this case, the conveyance of oil can be effected by gravity from the top of the recovery wells 11 to the oil trapping units.

The inlet and recovery galleries (8 and 9, respectively) may have the form of two twin workings (as shown in FIG. 2), as well as of a single working.

In any case, the extent of some or other galleries depends, among other things, upon the possibility of their reliable aeration in the course of driving and operation.

The oil well ventilation system should meet the requirements of labor protection and safety regulations for the service personnel.

In another embodiment of the disclosed method, when the top portion of the oil-bearing bed 7 is made up of poorly cemented, loose or markedly fissured rock, with a high-pressure water-bearing bed located below the oil-bearing bed, the inlet and recovery galleries are located in the bottom portion of the oil-bearing bed.

In this embodiment, following the setting up of the plurality of underground workings (shafts, mine yard, shaft workings, drifts in the overlying horizon, inclined workings), the method of the invention is accomplished by executing the following steps.

(1) Rectilinear recovery galleries 9 are provided in the bottom portion of the oil-bearing bed 7 at a distance of 500–700 m from each other (FIGS. 2, 3);

(2) in the design zone of the faces of the bottom row of the inlet wells 11 there are arranged rectilinear inlet galleries 8 located between the recovery galleries 9 in the bottom portion of the bed (in the top portion of the zone of transition from oil to bottom water);

(3) recovery and inlet wells (10 and 11, respectively) are drilled at a distance of 10–20 m between each other in the portion of the oil-bearing bed 7 between the inlet and recovery galleries (8 and 9, respectively). The wells are arranged in several rows (layers) over the bed thickness. In each row (layer), the inlet and recovery wells (10 and 11, respectively) are arranged alternately with each other or, depending upon geological conditions, several (2 to 5) recovery wells 11 are located between two inlet wells 10.

(4) the heat carrier (such as steam) is injected into the oil-bearing bed 7 via inlet wells 10 at a pressure of from 3 to 10 kgf/cm$^2$, with time intervals of from 15 to 30 days and pauses of the same duration.

Then, all of the inlet wells 10 of the element (area) under development are divided into groups, with the delivery of steam into each one of them being effected alternately, with the afore-mentioned time intervals of steam injection and shutdown of inlet wells 10;

(5) intermittent extraction of fluid (oil and water) is effected from the recovery wells 11;

(6) the cycles of heat carrier injection into the bed and oil extraction are repeated until full economically practical recovery of oil from the area under development.

In still another embodiment of the method of the invention in the case of oil-bearing beds 7 made up of poorly cemented and loose rock, with beds of stable and hard rock located therebelow, inlet and recovery wells (8 and 9, respectively) (FIG. 4) are located below the oil-bearing bed.

In this latter case, the method of the invention can be accomplished mainly through the execution of the aforedescribed steps, with due regard for the above-mentioned arrangement of the inlet and recovery galleries (8 and 9, respectively).

The operating conditions of the recovery wells 11 according to this latter embodiment are improved over those described above owing to a reduced possibility of sand plugging. Underground air in the workings is likewise improved owing to the location of the latter in oil-free rock.

The use of the herein disclosed method of mining an oil deposit results in an increased current production of oil and rate of oil extraction from the oil-bearing bed 7. Conditions are provided for a more uniform and intensive heating of the oil-bearing bed, as well as for a fuller coverage of the bed by the process of oil displacement by the heat carrier, which makes for an increased recovery and, as a result, for higher efficiency in the production of highly viscous oil.

The present invention also can be used advantageously in the production of fluid asphalts.

We claim:

1. A method of oil recovery by thermal mining from an oil deposit wherein a plurality of underground workings and recovery galleries are provided, comprising:

drilling rows of recovery wells from said recovery galleries;

providing inlet galleries each in the bed between two recovery galleries near the faces of said recovery wells;

drilling inlet wells from said inlet galleries toward said recovery wells such that said inlet and recovery wells alternate in the oil-bearing portions between said inlet and said recovery galleries to form a uniform network of wells enveloping said oil-bearing bed;

delivering a heat-carrier to said bed through said inlet wells;

thereby heating said bed sufficiently to fluidize said oil therein and displace said oil towards said recovery wells; and extracting said oil from said recovery wells to said recovery galleries.

2. The method of claim 1, wherein said oil is brought up to the surface from said recovery galleries through said workings and separated from said heat-carrier.

3. The method of claim 1 or 2, wherein said inlet and recovery galleries are drilled in the bottom portion of said oil-bearing bed.

4. The method of claim 1 or 2, wherein said inlet and recovery galleries are drilled below said oil-bearing bed.

5. The method of claim 1 or 2, wherein said inlet and recovery galleries are shaped rectilinearly.

6. The method of claim 1 or 2, wherein said inlet and recovery galleries are shaped curvilinearly.

7. The method of claim 1 or 2, wherein said inlet wells are drilled parallel to each other.

8. The method of claim 7, wherein said recovery wells are drilled parallel to each other.

9. The method of claim 7, wherein said recovery wells are drilled in the bottom portion of said bed at a distance of about 500 to 700 meters from each other.

10. The method of claim 9, wherein recovery and inlet wells are drilled at a distance of 10 to 20 meters between each other in the portion of said bed between said inlet and recovery galleries; said wells being arranged in several rows over the bed thickness.

11. The method of claim 10, wherein 2 to 5 recovery wells are arranged between two inlet wells.

12. The method of claim 11, wherein said heat carrier is introduced into said bed at a pressure of 3 to 10 $kgf/cm^2$ with time intervals of 15 to 30 days and pauses of similar duration.

* * * * *